US006491041B1

(12) United States Patent
Okamoto

(10) Patent No.: US 6,491,041 B1
(45) Date of Patent: Dec. 10, 2002

(54) CONTAINER HAVING CAP CONTAINER WITH HOLLOW LID

(75) Inventor: Shigeru Okamoto, Tokyo (JP)

(73) Assignee: Salada Town Co., Ltd., Tokyo (JP)

( * ) Notice: Subject to any disclaimer, the term of this patent is extended or adjusted under 35 U.S.C. 154(b) by 0 days.

(21) Appl. No.: 09/634,721

(22) Filed: Aug. 7, 2000

(30) Foreign Application Priority Data

Apr. 5, 2000 (JP) ..... 2000-103275

(51) Int. Cl.[7] ..... A45D 29/18

(52) U.S. Cl. ..... 132/74.5; 132/294; 220/521; 220/367.1; 215/354

(58) Field of Search ..... 132/73.5, 74.5, 132/75, 294, 297, 300, 314, 317, 318, 286; 206/581, 216, 219, 209; 215/6, 227, 228, 354; 220/521, 837, 839, 847, 367.1, 368

(56) References Cited

U.S. PATENT DOCUMENTS 1,598,365 A * 8/1926 Clarke ..... 132/314
1,865,489 A * 7/1932 Turner ..... 220/367.1
3,318,496 A * 5/1967 Ayotte et al. ..... 215/227
3,428,236 A * 2/1969 Bidwell ..... 220/367.1
2,524,865 A * 10/1983 Goncalves ..... 132/318
4,474,195 A * 10/1984 Warner ..... 132/73
4,635,657 A * 1/1987 Stanford ..... 132/286
4,869,612 A * 9/1989 Mooney et al. ..... 132/317
5,857,564 A * 1/1999 Hymowitz ..... 206/209
6,238,652 B1 * 5/2001 Natasi ..... 424/61

* cited by examiner

*Primary Examiner*—Nicholas D. Lucchesi
*Assistant Examiner*—David C. Comstock
(74) *Attorney, Agent, or Firm*—Armstrong, Westerman & Hattori, LLP

(57) ABSTRACT

A nail care set of nail enamel remover and nail cream and a container kit having a main container body for keeping the nail enamel remover, an auxiliary cap container for keeping the nail cream, and a hollow lid to fit in the auxiliary cap container.

2 Claims, 3 Drawing Sheets

CONTAINER HAVING CAP CONTAINER WITH HOLLOW LID

BACKGROUND OF THE INVENTION

1. Field of the Invention

This invention relates to a set of nail enamel remover/nail cream and a container kit for storing the set.

A manicure or nail enameling has been quite popular and is done repeatedly as a part of daily makeup.

However, nail enameling may or may not be good for health, while a manicure is not a permanent cosmotology similarly as most of the cosmetics. This is the reason why an enamel painted on nails is removed within rather a short period of time by means of a nail enamel remover.

Preferably, a nail care treatment is applied soon after the enamel is removed and, as a matter of fact, a special nail cream (a kind of protective cream) is commercially available.

Nevertheless, such a nail care is often neglected because of a troublesome treatment thereof or a relatively late appearance of adverse effects caused by enameling. As a result, undesirable injury of nail surface or nail itself as an adverse effect becomes remarkable gradually.

The nail enamel remover and the nail cream are conventionally kept in separate containers independently, which also causes negligence of nail care treatment. Here again, only an enamel removal is done without the nail care treatment.

SUMMARY OF THE INVENTION

Accordingly, it is an object of the present invention to provide a nail care set of nail enamel remover/nail nail cream stored in a single container.

Another object of the present invention is to provide a container kit for storing a nail care set comprising a main container body for keeping a nail enamel remover, an auxiliary cap container of the main body, which comprises a cap portion and a nail cream keeping space, and a peaked cap-like hollow lid for sealing up an opening of the nail cream keeping space, which has an air vent formed on the side facing to the opening of the space and is attached to the auxiliary cap container so as to easily open and close thereof.

DETAILED DESCRIPTION AND THE PREFERRED EMBODIMENT

Figure 1:
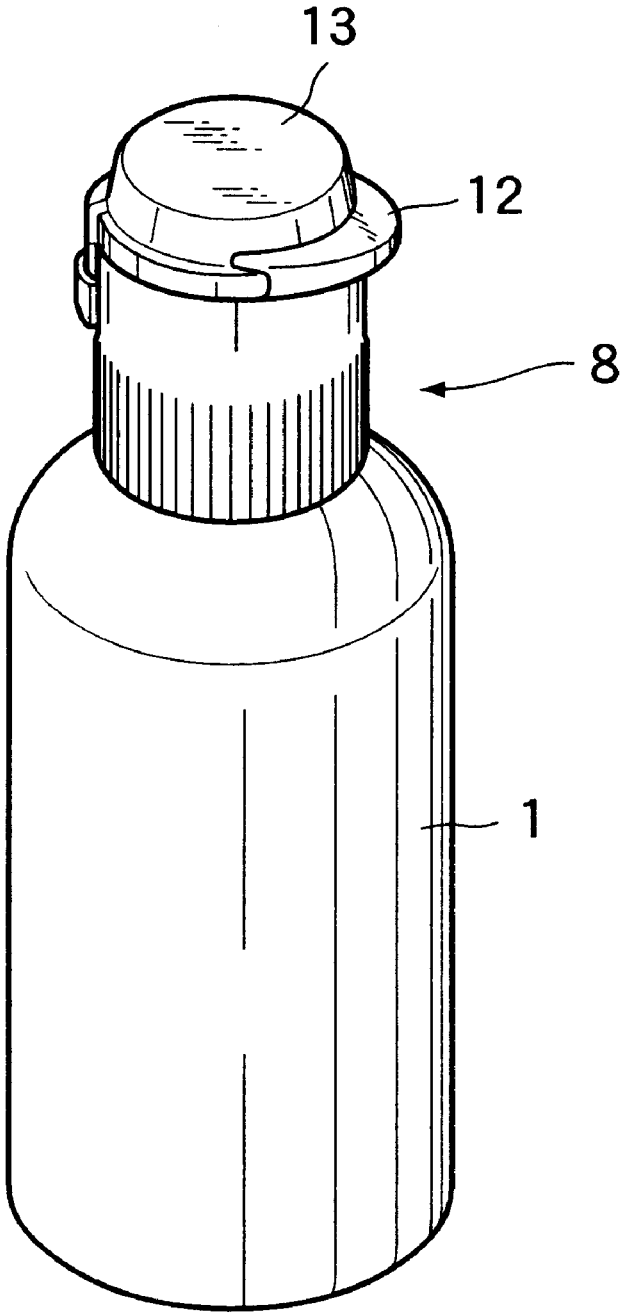
FIG. 1 is a perspective view of a container kit for storing a set of nail enamel remover/nail cream of the present invention.

A nail care set or a container kit for storing the nail care set is used without trouble and may not cause negligence of an after care treatment of nails because a nail enamel remover and a nail cream are always kept together.

The container kit of the present invention may be made of conventional materials.

As the nail enamel remover and the nail cream are compactly kept in a single container kit according to the present invention, it is not necessary to use a plurality of separate containers containing such a remover and cream, respectively. Further, a lid for sealing up an opening of a nail cream keeping space can be one-handed opened by means of a brim, which is also useful for an after care treatment of nails.

As an auxiliary container for keeping the nail cream and a main container body are changeable independently, the container kit itself can be used continuously by changing either the auxiliary or the main container when the cream or the remover is spent.

Referring now to the drawings, a preferred embodiment of the present invention will be further detailed in the following.

A main container body 3 having an open neck 2 with a thread 1 of the present nail care set is made of plastics, where an enamel remover is charged. The neck 2 is capped with a cap 6 having a small perforation 5 in the center for supplying the enamel remover 4.

An auxiliary cap container 8 with a thread 7 is made of hard plastics and provided with a protruded peripheral wall 9 to form a space 10 for keeping a nail cream 11.

A lady's cap-like lid 13 with a peak 12 is fitted integrally to the top of the auxiliary cap container 8 so as to easily open and close thereof and to prevent drying and leakage of nail cream.

The lid 13 is hollow and has an air vent 14 on the side facing to the space 10. The inside air vent 14 effectively prevents an adhesion of the nail cream to the lid 13 and allows the lid 13 to fit in the space 10 smoothly.

Figure 2:
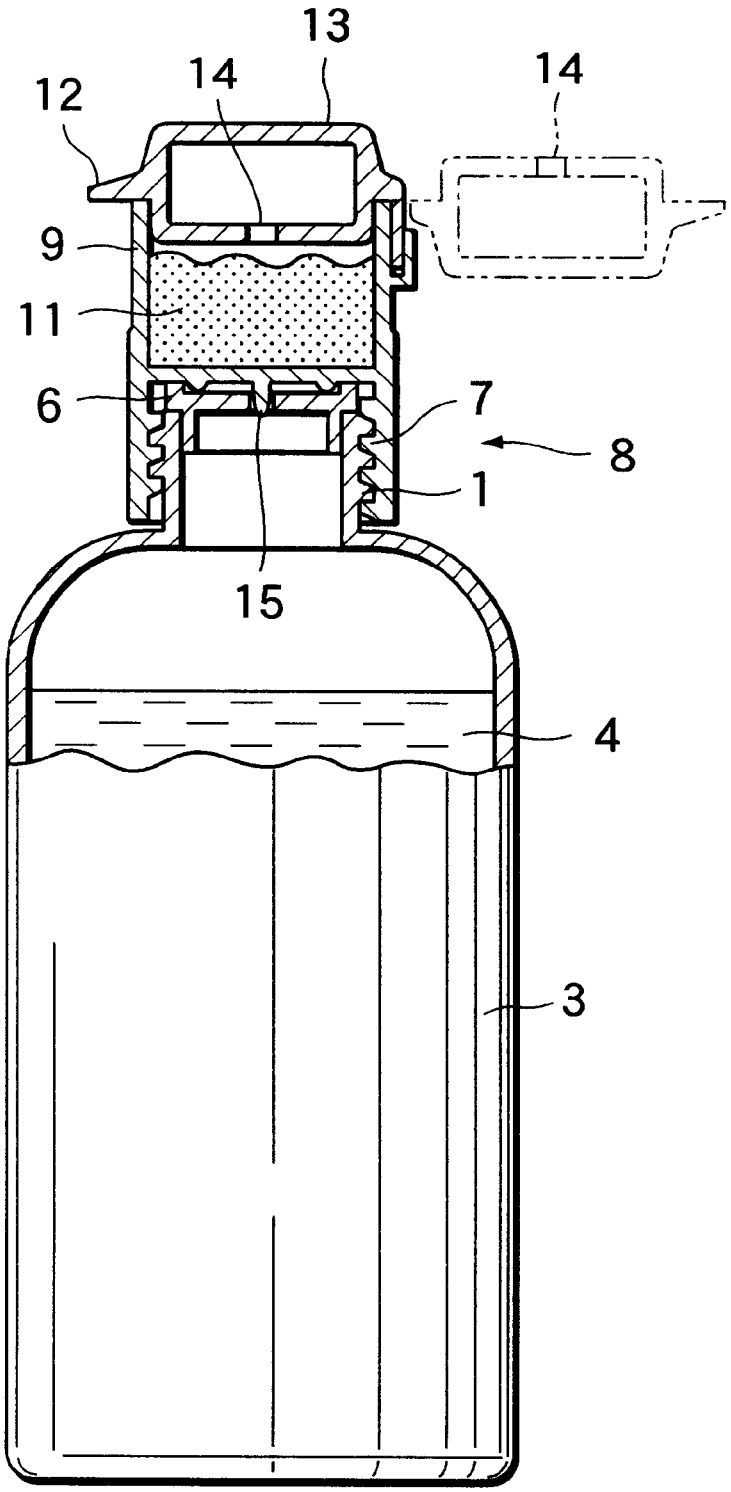
FIG. 2 is a central vertical section of a container kit of the present invention shown in FIG. 1.
Figure 3:
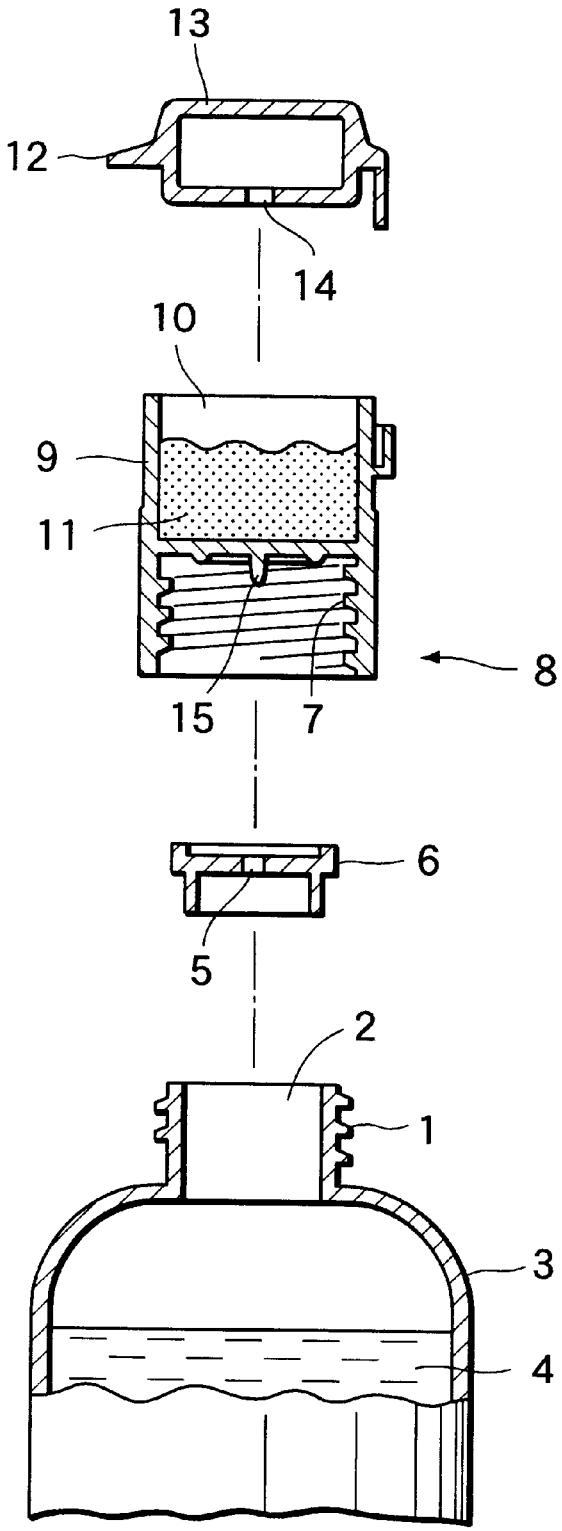
FIG. 3 is a partially disassembled illustration of a container kit of the present invention shown in FIG. 2.

In FIG. 2, a protrusion 15 fills up the small perforation 5 of the cap 5 when the enamel remover is not used.

What is claimed is:

1. A container kit for storing a nail care set comprising a main container body for keeping a nail enamel remover, an auxiliary cap container of the main body which comprises a cap portion arranged for capping said main container body and a separate nail cream keeping space, and a peaked cap-like hollow lid for sealing up an opening of the nail cream keeping space, said hollow lid having a vent between said hollow space and said nail cream keeping space, and solid walls between said hollow space and space external to said container kit so as to keep nail cream within said container kit, said hollow lid being attached to the auxiliary cap container so as to provide easy opening and closing of said nail cream keeping space.

2. A container kit for storing a nail care set according to claim 1, further comprising an additional cap, having a center perforation, arranged for capping said main container body, said cap portion of said auxiliary cap having a center protrusion directed toward said main container body, and said center perforation of said additional cap being arranged to be plugged by said center protrusion when said auxiliary cap is capping said main container body.

* * * * *